United States Patent [19]

Saleck et al.

[11] 4,075,020

[45] Feb. 21, 1978

[54] PROCESS FOR THE PREPARATION OF SILVER HALIDE EMULSIONS

[75] Inventors: Wilhelm Saleck, Schildgen; Harald von Rintelen, Leverkusen, both of Germany

[73] Assignee: AGFA-Gevaert Aktiengesellschaft, Leverkusen-Bayerwerk, Germany

[21] Appl. No.: 707,812

[22] Filed: July 22, 1976

[30] Foreign Application Priority Data

July 30, 1975 Germany ..... 2534011

[51] Int. Cl.[2] ..... G03C 1/02; G03C 1/28

[52] U.S. Cl. ..... 96/94 R; 96/113; 96/114; 96/114.7; 96/107; 96/108

[58] Field of Search ..... 96/94 R, 107-108, 96/113, 114, 114.7

[56] References Cited

U.S. PATENT DOCUMENTS

| | | | |
|---|---|---|---|
| 2,592,250 | 4/1952 | Davey et al. | 96/114.7 |
| 3,761,266 | 9/1973 | Milton | 96/94 R |
| 3,935,014 | 1/1976 | Klötzer et al. | 96/94 R |

FOREIGN PATENT DOCUMENTS

| | | | |
|---|---|---|---|
| 1,027,146 | 4/1976 | United Kingdom | 96/94 R |

OTHER PUBLICATIONS

Duffin; Photographic Emulsion Chemistry, The Focal Press, 11-1969, pp. 59-60.

*Primary Examiner*—Won H. Louie, Jr.
*Attorney, Agent, or Firm*—Connolly and Hutz

[57] ABSTRACT

A silver halide emulsion is made by continuous conversion of a more soluble silver halide into a less soluble silver halide. From a first part of up to 50% of the total amount of silver nitrate by reaction with a first water soluble halide a silver halide is precipitated consisting at least partly of a more readily soluble silver halide, e.g. silver chloride. In the presence of this more readily soluble silver halide the remaining silver nitrate is reacted with a second water soluble halide composition to form the residual silver halide (main precipitation). The amount of total halide in the precipitation is slightly more than equivalent to the amount of silver ions. However the amount of halide that forms the less readily soluble silver halide is less by at least 5 mol% than equivalent to the amount of silver ions in the precipitation medium.

5 Claims, No Drawings

PROCESS FOR THE PREPARATION OF SILVER HALIDE EMULSIONS

This invention relates to a light-sensitive photographic silver halide emulsion and to a process for its preparation. In the method of preparation according to the invention, precipitation of the silver halide is accompanied by partial conversion of a more soluble silver halide into a less soluble silver halide.

Silver halide emulsions prepared by conversion of a more soluble silver halide into a less soluble silver halide have already been disclosed, for example in U.S. Pat. No. 2,592,250. In this known process, a silver chloride emulsion is first prepared and, after its precipitation, the silver chloride is at least partly converted into more sparingly soluble silver halides (silver bromide, silver iodide) by reaction with an aqueous solution of an alkali metal bromide or alkali metal iodide or a mixture thereof. This conversion presumably takes place mainly on the surface, so that the concentration of the less soluble silver halide decreases towards the centre of silver halide grains. The silver halide emulsions obtained in this way have a relatively high sensitivity in the interior of the silver halide grains and a relatively low sensitivity on their surface and are therefore usually referred to as "internal latent image emulsions". Their surface sensitivity can, however, be considerably increased by chemical sensitization. Another silver halide emulsion which contains converted silver halide but in which the centre of the silver halide grain has a certain silver halide content has been disclosed in German Offenlegungsschrift No. 2,436,180.

Although the known silver halide emulsions with converted silver halide have a better maximum density than conventional silver halide emulsions in which the silver halide has not been converted, there still remains a need for silver halide emulsions with a much higher maximum density for a given amount of silver application. Another factor which is of major importance in modern photographic materials, particularly in colour photographic materials, is the relationship between sensitivity and graininess. In any given type of emulsion, increase in sensitivity is generally obtained at the expense of graininess.

It is an object of the present invention to provide photographic silver halide emulsions in which the graininess is improved without the sensitivity being substantially reduced. In addition, it is intended to improve the development kinetics in the sense of improving the utilisation of sensitivity and capacity for complete development. Lastly, it is intended to increase the maximum density for a given quantity of silver application.

It has been found that silver halide emulsions with the desired properties are obtained if conversion of the more readily soluble silver halide into more sparingly soluble silver halide is allowed to take place not only after completion of precipitation but already during the precipitation process.

The invention relates to a process for the preparation of silver halide emulsions by the reaction of an aqueous solution of a watersoluble silver salt with an aqueous halide solution in the presence of solid particles which consist of least partly of a sparingly soluble silver salt which has a first solubility product which is higher than that of the silver halide which is to be precipitated. The process is characterised in that the reaction is carried out under conditions which bring about partial conversion of the sparingly soluble silver salt which has a higher solubility product into sparingly soluble silver halide which has a lower solubility product.

The solubility of the various different sparingly soluble silver salts involved in the process of our invention is referred to in terms of solubility product. The skilled worker is familiar with this term which indicates in a saturated salt solution being in contact with solid salt the product of the molar concentrations of the anion and of the cation. The more soluble salt has the higher solubility product.

In practical detail, the method is carried out as follows: silver halide particles are first produced by the usual methods of precipitation in the presence of a protective colloid such as gelatine. These silver halide particles consist at least partly of the more readily soluble silver salt, e.g. silver chloride, and may contain other silver halides in addition, e.g. silver bromide and/or silver iodide. Up to 50%, preferably 5 to 30%, of the total quantity of silver nitrate is generally used for this part of the process. The desired grain size distribution can be obtained in known manner by observing certain precipitation conditions, e.g. maintaining a certain pAg-value. The average particle size of the silver halide precipitated at this stage is preferbly between 0.1 and 0.8 μm. Further reaction of the major quantity of silver nitrate with excess halide is then carried out in the presence of this initially precipitated silver halide. The molar excess of total halide in the precipitation medium is at least 2%, preferbly 5 to 30%, based on the total quantity of silver salt which is to be reacted, but it may also be substantially higher, e.g. 100% or more. Reference may be had in this connection to German Patent Application Offenlegungsschrift 2 531 599. In the process according to the present invention, however, the proportion of total halide which forms the more sparingly soluble silver halide is calculated so that its molar quantity is less by at least 5% than the total quantity of silver salt. The remainder of the total quantity of halide consists of a halide which forms a more readily soluble silver halide, for example a chloride, and it may be the same as the bulk of the halide previously used for the initial precipitation. This method ensures that during the main precipitation, a small portion of silver halide is present at least part of the time as the more readily soluble silver halide, e.g. silver chloride, which can be converted into more sparingly soluble silver halide during a later stage of precipitation. In order to promote this conversion, precipitation, if carried out continuously, is carried out sufficiently slowly so that, for example, precipitation of 1 mol of silver halide takes at least one minute and preferably 3 to 30 minutes, or precipitation may be interrupted by one or more intervals during which conversion can take place.

In the process according to the present invention, the major quantity of silver salt solution are introduced either simultaneously or alternately into the precipitation chamber after the initial precipitation has been completed. The two components may be added either continuously or portionwise. If the addition is portionwise, it is suitably interrupted by precipitation intervals to make it possible for a precipitation equilibrium to be established and at least partial conversion to take place.

Part of the major quantity of soluble halide, e.g. up to 20%, may already be present in the precipitation chamber from the initial precipitation or may be introduced into the precipitation chamber at the beginning of the main precipitation stage, i.e. after termination of the initial precipitation, before introduction of the major quantity of silver salt solution is begun.

In another variation of the process according to the invention, the molar quantity of halide ions present in the precipitation chamber to form the more sparingly soluble silver salt may from time to time but only transitorily reach or even slightly exceed the molar quantity of silver ions so long as such a precipitation phase is followed by another precipitation phase in which the molar quantity of the halide ions which are to form the more sparingly soluble silver ssalt remains less by at least 5% than the molar quantity of silver ions. By this method it is possible to obtain silver halide grains in which layers of converted silver halide alternate with layers of unconverted silver halide.

The silver halide grains obtained at the end of the precipitation process generally consist largely of converted silver halide and are covered with a thin skin of more readily soluble silver halide emulsions obtained in this way may be subjected in known manner to a residual conversion which consists of digesting them in the presence of the halide which forms the more sparingly soluble silver salt, e.g. in the presence of an alkali metal bromide.

This residual conversion may, however, be omitted since the silver halide emulsions with silver chloride skin obtained by the precipitation process are found to be extremely advantageous for numerous purposes.

The process according to the invention may be used for preparing silver bromide, silver iodobromide, silver chlorobromide and silver chloroiodobromide emulsions. The silve halide emulsions generally contain at least 40 mol % of silver bromide and may contain up to 60 mol% of silver chloride and up to 15 mol %, preferably from 0.5 to 10 mol% of silver halide. Silver halide emulsions prepared according to the invention which consist substantially of silver bromide and have a silver chloride content of from 0.5 to 10 mol% are also suitable for some purposes.

Precipitation of the silver halide is suitably carried out at elevated temperatures, for example from 45° C to 75° C. Gelatine is a very suitable protective colloid to use for the precipitation of silver halide, but it may be replaced partly or completely by other natural or synthetic polymers, e.g. by homopolymers or copolymers of acrylic or methacrylic acid derivatives, e.g. those described in German Offenlegungsschriften 2 506 405 and 2 508 279. Other suitable additives for the precipitation mixture include, for example, silicic acid sols according to German Offenlegungsschrift No. 1,797,254 and 2,015,405 and phosphoric ester amides according to German Offenlegungsschrift No. 2,159,379

After completion of precipitation and if desired final conversion, the emulsion is flocculated in the usual manner, for example by the addition of polystyrene sulphonic acid and reduction of the pH to 3.0, and decanted and washed to free it from excess salts. The flocculate is redispersed in an aqueous solution with addition of the desired quantity of gelatine and increase in the pH. It may then be mixed with the usual ripening additives and chemically ripened to maximum sensitivity at a given temperature at a pH of from 5.0 to 6.8 and a pAg of from 8.6 to 9.2. Noble metal salts such as gold salts or salts of platinum metals may be added for after-ripening as required. However the emulsions of the present invention are of particular use as direct-positive silver halide emulsions if they are not or only slightly chemically ripened at the surface of the silver halide grains. This is presumably attributable to the great number of stack faults in the interior of the grains originating from the continuous conversion of the silver halide. For this use the emulsions are not chemically ripened or preferably chemically ripened at most to such a degree that a sample of the material containing such direct-positive emulsion after exposure is developed in a surface developer to produce a maximum density not higher than 0.4.

The binder used for the photographic layers is preferably gelatine but this may be partly or completely replaced by other natural or synthetic binders. Suitable natural binders include e.g. alginic acid and its derivatives such as carboxymethylcellulose, alkyl celluloses such as hydroxyethyl cellulose, starch or its derivatives such as ethers or esters,or carrageeenates. Suitable synthetic binders include polyvinyl alcohol, partially saponified polyvinyl acetate and polyvinylpyrrolidone.

The emulsions may also be chemically sensitized, for example by the addition of sulphur compounds such as allylisothiocyanate, allyl thiourea or sodium thiosulphate during chemical ripening. The chemical sensitizers may also be reducing agents, for example the tin compounds described in Belgian Patent Specifications No. 493,464 and No. 568,687, or polyamines such as diethylenetriamine or aminomethanesulphinic acid derivatives, e.g. according to Belgian Patent Specification No. 547,323.

Noble metals such as gold, platinum, palladium, iridium, ruthenium or rhodium and compounds of these metals may also be used as chemical sensitizers. This method of chemical sensitization has been described in the article by R. Koslowsky, in Z. Wiss. Phot. 46, 65 to 72 (1951). However, as stated above, the emulsions are of particular use as direct positive silver halide emulsions, if they are not or only slightly chemically ripened at the surface of the silver halide grains.

The emulsions may also be sensitized with polyalkylene oxide derivatives, for example with a polyethylene oxide having a molecular weight of between 1000 and 20,000, or with condensation products of alkylene oxides, e.g. with aliphatic alcohols, glycols, cyclic dehydration products of hexitols, alkyl substituted phenols, aliphatic carboxylic acids, aliphatic amines, aliphatic diamines and amides and phosphoric acid esters. The condensation products have a molecular weight of at least 700 and preferably more than 1000. These sensitizers may, of course, be combined to achieve special effects, as described in Belgian Patent Specification No. 537,278 and in British Patent Specification No. 727,982. Ripening accelerators are also particularly suitable for after-ripening, for example those described in German Offenlegungsschrift No. 1,472,792.

The emulsions may also be spectrally sensitized, for example with the usual monomethine or polymethine dyes such as acid or basic cyanines, hemicyanines, streptocyanines, merocyanines, oxonols, hemioxinols, styryl dyes and others as well as trinuclear or higher nuclear methine dyes, for example rhodacyanines or neocyanines. Sensitizers of this kind have been described, for example, in the work by F. M. Hamer "The Cyanine Dyes and Related Compounds" (1964), Interscience Publishers John Wiley and Sons.

The emulsions may contain the usual stabilizers, e.g. homopolar or salt compunds of mercury having aromatic or heterocyclic rings, such as mercaptotriazoles, or simple mercury salts, sulphonium mercury double salts and other mercury compounds. Azaindenes are also suitable stabilizers, particularly tetra- or penta-azaindenes and especially those which are substituted with hydroxyl or amino groups. Compounds of this kind have been described in the article by Birr. in Z. Wiss. Phot. 47, 2 to 27 (1952). Other suitable stabilizers include heterocyclic mercapto compounds, e.g. phenyl mercaptotetrazole, quaternary benzothiazole derivatives, benzotriazole and the like. Particularly suitable stabilizers have been described inter alia in German Offenlegungsschrift No. 1,597,503.

Derivatives of hydroquinone and pyrocatechol as well as the cyclic thiouronium compounds according to German Patent Specification No. 1,209,425 may be added as casting additives to the emulsion layers or adjacent intermediate layers to improve fogging, particularly in colour photographic layers.

The emulsions may be hardened in the usual manner, for example with formaldehyde or halogenated aldehydes containing a carboxyl group, such as mucobromic acid, diketones, methane sulphonic acid esters and dialdehydes.

Photographic emulsions may also be hardened with epoxide hardeners, heterocyclic ethylene imine hardeners or acryloyl hardeners. Examples of such hardeners have been described e.g. in German Offenlegungsschrift No. 2,263,602 and in British Pat. Specification No. 1,266,655. The layers may also be hardened by the process according to German Offenlegungsschrift No. 2,218,009 to obtain colour photographic materials suitable for high temperature processing.

The photographic layers or colour photographic multi-layered materials may also be hardened with hardeners of the diazine, triazine or 1,2-dihydroquinoline series as described in British Pat. Specifications No. 1,193,290, No. 1,251,091, No. 1,306,544 and No. 1,266,655, French Pat. Specification No. 7,102,716 or German Offenlegungsschrift No. 2,322,317. The following are examples of such hardeners: diazine derivatives having alkylsulphonyl or arylsulphonyl groups, derivatives of hydrogenated diazines or triazines such as 1,3,5-hexahydrotriazine, fluorinated diazine derivatives such as fluoropyrimidines and esters of 2-substituted 1,2-dihydroquinoline- or 1,2-dihydroisoquinoline-N-carboxylic acids. Other suitable hardeners include vinyl sulphonic acid hardeners, carbodiimide hardeners and carbamoyl hardeners, e.g. those described in German Offenlegungsschriften No. 2,263,602, 2,225,230 and 1,808,685, French Patent specification No. 1,491,807, German Patent Specification No. 872,153 and DRR Patent Specification No. 7 218. Other suitable hardeners have been described, for example, in British Patent Specification No. 1,268,550.

The silver halide emulsions prepared by the process according to the invention are distinguished from known converted emulsions in that their conversion does not take place only after completion of the precipitation of the silver halide but already during precipitation. In this way, continuous conversion is achieved while the silver halide grain is built up. This presumably leads to the formation of a larger number of developing nuclei or zones of disturbance in the lattice of the silver halide which is being produced and hence to a higher sensitivity for the same grain size. The silver halide emulsions prepared according to the invention provide higher maximum densities for a given quantity of silver applied than the known convert emulsions. The sensitometric properties, in particular the gradation, can be much more easily influenced in emulsions prepared accordingg to the invention, simply by varying the addition of iodide, and hence can be adapted to the given requirements. Lastly, silver halide emulsions prepared according to the invention have improved development kinetics with regard to utilization of the sensitivity and capacity for complete development, a factor which is of considerable importance in colour photographic materials. The emulsions are particularly suitable for high temperature development with colour developers at temperatures of between 30° and 50° C.

The invention will now be illustrated by the following examples.

EXAMPLE 1

Emulsion 1

Preparation of a conventional converted emulsion: The following solutions are prepared:

| | | | |
|---|---|---|---|
| Solution A | 1500 | ml of water | |
| | 15 | g of an inert gelatine | Temperature 45° C |
| | 55 | g of sodium chloride | |
| Solution B | 600 | ml of water | Temperature 45° C |
| | 7.5 | g of potassium iodide | |
| | 115 | g of potassium bromide | |
| Solution C | 600 | ml of water | |
| | 150 | g of silver nitrate | Temperature 40° C |

Solution C is run into Solution A over a period of 10 minutes. After an interval of 5 minutes, Solution B is added over a period of 2 minutes and the mixture is left to digest for a further 30 minutes at 45° C.

The emulsion is then flocculated by the addition of polystyrene sulphonic acid and reduction of the pH to 3.0 with mineral acid, decanted and washed to remove excess water-soluble salts. It is then redispersed at pH 7.0 and mixed with the required quantity of gelatine. Sodium thiosulphate and gold chloride are added and the emulsion is ripened to maximum sensitivity at a temperature of between 50° and 60° C and at a pH of between 5.5 and 6.5 and a pAg of from 8.6 to 9.2

Emulsion 2

Preparation of an emulsion in accordance with the concept of the invention of continuous conversion.

The following solutions are prepared:

| | | | |
|---|---|---|---|
| Solution A | 700 | ml of water | |
| | 13 | g of an inert gelatine | Temperature 45° C |
| | 11 | g of sodium chloride | |
| | 6.7 | g of potassium iodide | |
| Solution B | 700 | ml of water | |
| | 36 | g of sodium chloride | Temperature 45° C |
| | 70 | g of potassium bromide | |
| Solution C | 350 | ml of water | |
| | 38 | g of potassium bromide | Temperature 45° C |
| Solution D | 700 | ml of water | |
| | 133 | g of silver nitrate | Temperature 40° C |

60 ml of Solution D is added to Solution A over a period of 2 minutes. After an interval of one minute, Solution B and the remainder of Solution D are added simultaneously by the method of double inflow over a period of 5 minutes. After a further interval of 5 minutes, Solution C is added over a period of one minute and the mixture is digested for 20 minutes at 45° C. The process is then continued as described for reaction mixture 1.

A portion of each of the two experimental emulsions is made ready for casting by adding 20 ml of a 1% methanolic solution of 4-hydroxy-6-methyl-1,3,3α,7-tetraazaindene, 10 ml of a 10% formalin solution and 10 ml of a 5% aqueous saponin solution as wetting agent per kg. The emulsions are cast on a cellulose acetate substrate and the film samples obtained are exposed behind a grey wedge and developed for 7 minutes in a developer of the following composition:

| | | |
|---|---|---|
| Sodium sulphite sicc. | 70.0 | g |
| Borax | 7.0 | g |
| Hydroquinone | 3.5 | g |
| p-monomethylaminophenol sulphate | 3.5 | g |
| sodium citrate | 7.0 | g |
| potassium bromide | 0.4 | g |
| made up to 1 liter with water. | | |

Table 1

| Reaction mixture | Silver application g of $AgNO_3/m^2$ | Sensitivity | 7 minutes development γ | fog | $D_{max}$ |
|---|---|---|---|---|---|
| 1 (comparison) | 3.1 | blank | 0.65 | 0.12 | 1.7 |
| 2 | 3.0 | + 1.5° | 0.90 | 0.12 | 2.4 |
| | | 3° = 1 shutter stop | | | |

Table 1 shows the results of the photographic examination. Compared with the conventional converted emulsion (Emulsion 1), the emulsion according to the invention (emulsion 2) prepared by the process of continuous conversion is more sensitive and steeper and has a higher maximum density.

Individual colour photographic layers were cast to show that this effect is also applicable to colour photographic layers. Another portion of emulsions 1 and 2 described above was made ready for casting by introducing into the reaction vessel 8 ml of a 1% methanolic 4-hydroxy-6-methyl-1,3,3α,7-tetraazaindene solution at 40° C. Sufficient 8% aqueous gelatine solution is then added to obtain a suitable application of silver. The following additives are then added in the sequence given: 0.2 ml of glycerol/water (1:1), 14 ml of panchromatic sensitizer (Formula A, see below) dissolved 1 : 1000 in aqueous methanol, stirred for 45 minutes at 40° C, 2.5 g of cyan coupler (Formula B, see below) in emulsified form with tricresylphosphate and gelatine (1 : 1 : 1 ) 0.1 g of chrome alum as hardener.

Both experimental emulsions are cast on a cellulose acetate substrate provided with an antihalation layer having a thickness of 1μ. A protective layer 5 to 8μ in thickness is poured over the silver halide emulsion layer. The casting solution used for this protective layer has the following composition:

200 ml of gelatine solution (3%),
5 ml of wetting agent (Formula C, see below),
1 ml of chrome alum.

To achieve rapid hardening, both materials are passed through a solution containing 200 ml of gelatine solution (1%),
8 ml of wetting agent (Formula C)
2 g of hardener (Formula D, see below).

After drying, the film strips are exposed behind a grey wedge and red filter and colour developed for 3¼ minutes at 38° C. The colour developer contains 5 g of 2-amino-5-(N-ethyl-N-hydroxyethylamino)-toluene as developer substance per liter.

The results are represented in Table 2

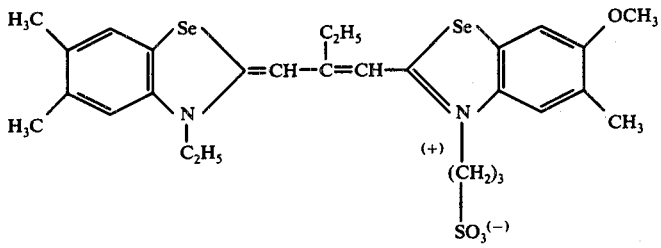

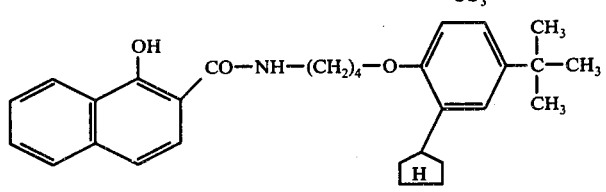

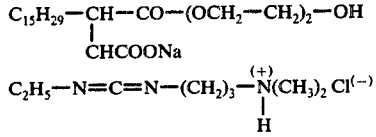

Table 2

| Experiment | Silver application g/$AgNO_3/m^2$ | 3'15" development C 41 Sensitivity | γ | fog | $D_{max}$ | $\delta_D \cdot 10^2$ at D = 1.0 above fog |
|---|---|---|---|---|---|---|
| 1 (comparison) | 2.0 | blank | 1.5 | 0.13 | 3.0 | 3.0 |
| 2 | 2.1 | + 1.5° | 1.8 | 0.15 | 3.8 | 2.6 |
| | | 3° = 1 shutter stop | | | | |

Here again the emulsion according to the invention has a higher sensitivity and higher maximum density but above all the colour graininess is finer (smaller figure)

although the gradation is steeper, a factor which always leads to a coarser assessment of graininess. The following literature may be referred to for determination of the colour graininess:

1. Jones et al, J. of the Optical Society of America, Vol 47 (1957), page 312.
2. H. Frieser, Mitteilungen aus den Forschungslaboratorie der Agfa, Leverkusen-Munich, Vol II (1958) page 249.

EXAMPLE 2

An emulsion was prepared according to the invention following the following procedure:

From 30% of the total amount of silver nitrate silver chloride particles of an average grain size of 0.6μm were precipitated at 70° C in an inert gelatin solution. After addition of 2 mol% of potassium iodide (aqueous solution) related to the total amount of silver nitrate, further silver halide was precipitated on said particles by simultaneously adding aqueous silver nitrate and potassium bromide solutions. At the end of precipitation the silver halide consisted of 78 mol% of silver bromide, 2 mol% of silver iodide and 20 mol% of silver chloride. By further addition of potassium bromide the silver chloride of the external shell surrounding the silver halide grain was converted into silver bromide.

After a digestion period of 20 minutes at 45° C the total silver halide was found by analysis to contain 10 mol % of silver chloride. The emulsion was then flocculated by the addition of polystyrene sulfonic acid and mineral acid to reduce the pH to 3.0, decanted and washed. It was then redispersed at 40° C in a gelatin solution at a pH-value between 6.0 and 7.0. The pAg was adjusted with a halide solution to 9.3 and the pH to 6.0.

Using this direct positive emulsion a light sensitive element was prepared by applying the following layers onto a transparent support of polyethylene terephthalate film. The amounts are given in each case per $1m^2$.

1. A mordanting layer of 3.6 g of octadecyl-trimethyl-ammonium methylsulfate and 9.0 g of gelatin.
2. A white pigment layer of 48 g of $TiO_2$ and 4.8 g of gelatin.
3. An interlayer of 2.6 g of gelatin.
4. A dye layer containing 0.8 g of a dye-giving compound (formula E, see below) and 1.6 g of gelatin.
5. A green sensitized direct-positive silver halide emulsion layer (the emulsion as prepared above) containing 1 mg of 1-(3'-carboxyphenyl)-5-mercaptotetrazole, 40 mg of octadecylhydroquinone sulfonic acid, 4 mg of acetylphenylhydrazine and 0.85 g of gelatin; silver application 1.1 g.
6. A cover layer of 2.6 g of gelatin.

A sample of this light sensitive element was exposed behind a step wedge. A rupturable container containing the viscous developer paste was fixed at one edge of the sample. The sample was covered by a polyester foil (cover sheet) at a distance of 180μm secured by two parallel spacer strips and the assemblage was guided through a pair of pressure applying rollers to spread the viscous developer paste between the light sensitive element and the cover sheet. The following composition was used as developer paste:

40 g of potassium hydroxide
10 ml of benzylalcohol
1 g of paraformaldehyde
3 g of benzotriazole
0,25 g of ascorbic acid
1.3 g of 1-phenyl-4-hydroxymethyl-4-methyl-3-pyrazolidone
0,1 g of hydroquinone
30 g of hydroxyethylcellulose made up with water to 1 liter. After 10 minutes the light-sensitive element was separated and freed from the developer paste adhering to it. A positive magenta image was visible through the transparent support against the white background of the $TiO_2$ layer. The minimum color density was 0.3; the maximum color density was 2.1 and the gradation was 1.7.

Compound E had the following formula:

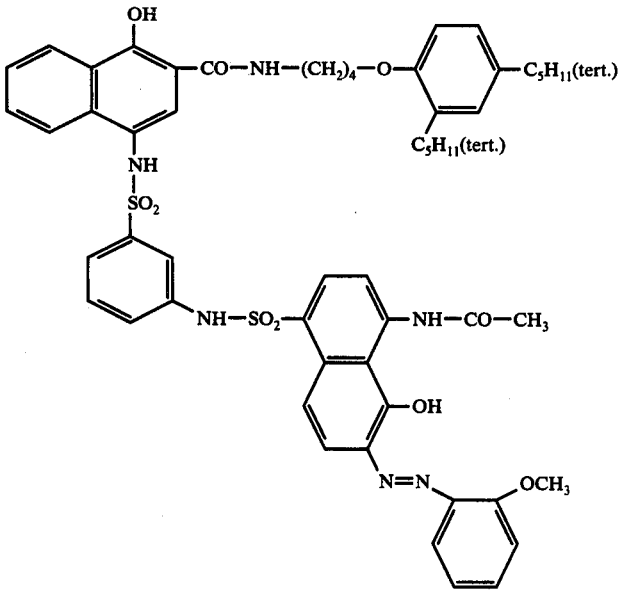

We claim:

1. A process of producing a silver halide emulsion comprising the step of precipitating silver halide by reacting an aqueous solution of a silver salt with an aqueous halide solution in the presence of a hydrophilic binder, wherein the improvement comprises a. reacting from 5 to 30% of the total amount of soluble silver salt with a soluble chloride composition to form silver halide particles comprising silver chloride having a first solubility product, and b. precipitating onto said particles further silver halide and simultaneously converting at least part of the silver chloride particles to a silver bromide selected from the group consisting of silver bromide, silver iodobromide, silver chlorobromide and silver chloroiodobromide having a second solubility product which is lower than said first solubility product when the solubility products of the respective halides are determined at the same constant temperature, by reacting in the presence of said silver chloride particles the residual amount of soluble silver salt with a composition selected from the group consisting of soluble chlorides, bromides and iodides containing the halide that forms the silver bromide having a second solubility product wherein, in the precipitation medium at least transitorily during said precipitation the quantity of the halide which forms the silver bromide with the second solubility product is less than equivalent to the quantity of silver ions by at least 5% and the total concentration of the added halide ions is greater than the total concentration of added silver ions by at least 5%, such that the silver bromide comprises from 40 – 100 mol% of the silver halide and the silver chloride comprises from 0 – 60 mol% of silver halide and the silver iodide comprises 0 –15 mol % of the silver halide.

2. The process as claimed in claim 1, in which the silver halide is precipitated by simultaneous or alternating addition of soluble silver salt and soluble halide.

3. The process as claimed in claim 1, in which precipitation of residual amount of silver salt takes at least one minute.

4. The process as claimed in claim 1, in which after termination of precipitation, the precipitated silver salt is digested in the presence of an excess of alkali metal bromide.

5. The process as clained in claim 1 in which after termination of precipitation the emulsion not chemically sensitized or is chemically sensitized only to such an extent to produce on development in a surface developer a silver density not higher than 0.4.

* * * * *